US008624824B2

(12) United States Patent
Feng

(10) Patent No.: US 8,624,824 B2
(45) Date of Patent: Jan. 7, 2014

(54) AREA ADAPTIVE BACKLIGHT WITH REDUCED COLOR CROSSTALK

(75) Inventor: Xiao-fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 938 days.

(21) Appl. No.: 12/383,194

(22) Filed: Mar. 19, 2009

(65) Prior Publication Data

US 2010/0238189 A1 Sep. 23, 2010

(51) Int. Cl.
*G09G 5/02* (2006.01)

(52) U.S. Cl.
USPC ..... 345/102; 345/690; 345/58; 345/84; 345/207; 345/83; 345/88; 345/89; 362/97.1; 362/97.2; 362/97.3

(58) Field of Classification Search
USPC ..... 345/102, 589, 690, 84, 207, 58, 83, 88, 345/89; 362/97.1–97.3
See application file for complete search history.

(56) References Cited

U.S. PATENT DOCUMENTS

| | | | | |
|---|---|---|---|---|
| 4,631,691 | A * | 12/1986 | Pica | 382/280 |
| 5,471,228 | A * | 11/1995 | Ilcisin et al. | 345/58 |
| 6,809,741 | B1 * | 10/2004 | Bates et al. | 345/597 |
| 8,279,138 | B1 * | 10/2012 | Margulis | 345/1.1 |
| 2005/0001537 | A1 * | 1/2005 | West et al. | 313/500 |
| 2005/0231457 | A1 | 10/2005 | Yamamoto et al. | |
| 2005/0248520 | A1 * | 11/2005 | Feng et al. | 345/87 |
| 2006/0181534 | A1 * | 8/2006 | Meinds et al. | 345/473 |
| 2006/0262078 | A1 * | 11/2006 | Inuzuka et al. | 345/102 |
| 2006/0284972 | A1 * | 12/2006 | Aoki et al. | 348/51 |
| 2007/0268695 | A1 * | 11/2007 | Seetzen | 362/231 |
| 2008/0007509 | A1 * | 1/2008 | Lankhorst et al. | 345/102 |
| 2008/0024696 | A1 * | 1/2008 | Arai et al. | 349/62 |
| 2008/0129677 | A1 * | 6/2008 | Li et al. | 345/102 |
| 2008/0129680 | A1 * | 6/2008 | Kimura et al. | 345/102 |
| 2009/0009456 | A1 * | 1/2009 | Ohshima | 345/89 |
| 2010/0007599 | A1 * | 1/2010 | Kerofsky | 345/102 |

FOREIGN PATENT DOCUMENTS

| | | | |
|---|---|---|---|
| JP | 2002-077659 | | 3/1990 |
| JP | 2005-258404 | | 9/2005 |
| JP | 2005-258404 | A | 9/2005 |
| JP | 2007-279734 | A | 10/2007 |
| JP | 2008-071603 | | 3/2008 |
| JP | 2008-258094 | A | 10/2008 |
| JP | 2008-304908 | | 12/2008 |

OTHER PUBLICATIONS

European Search Report, dated Jul. 6, 2012, in PCT International App. No. PCT/JP2010/052576, Sharp Kabushiki Kaisha, 6 pgs.
International Search Report dated May 18, 2010 relating to co-pending application No. PCT/JP2010/052576, filed Feb. 15, 2010; pp. 1-9.

(Continued)

*Primary Examiner* — Lun-Yi Lao
*Assistant Examiner* — Peter D McLoone
(74) *Attorney, Agent, or Firm* — Chernoff Vilhauer McClung & Stenzel, LLP

(57) ABSTRACT

A backlight display has improved display characteristics. An image may be displayed on the display where the image includes a liquid crystal material with a light valve. The display receives an image signal and uses the image signal to modify the light for a backlight array and a liquid crystal layer.

9 Claims, 11 Drawing Sheets

(56) References Cited

OTHER PUBLICATIONS

Decision to Grant (English translation), Russian App. No. 2011135606/28(052845), filed Feb. 15, 2010, by Sharp Kabushiki Kaisha, dated Mar. 1, 2013, 7 pgs.
Decision to Grant (Russian), Russian App. No. 2011135606/28(052845), filed Feb. 15, 2010, by Sharp Kabushiki Kaisha, dated Mar. 1, 2013, 7 pgs.
English translation of Abstract for Japanese Pub. No. 2005-258404, published Sep. 22, 2005, Hitachi Ltd., 2 pgs.
English translation of Abstract for Japanese Pub. No. 2007-279734, published Oct. 25, 2007, Samsung Electronics Co. Ltd., 1 pg.
English translation of Abstract for Japanese Pub. No. 2008-258094, published Oct. 23, 2008, M&S Fine Tec KK, 1 pg.
Chinese Official Communication, Chinese Patent App. No. 201080009100.0, Sharp Kabushiki Kaisha, mailed Aug. 30, 2013, 2 pgs.
English Translation of Chinese Official Communication, Chinese Patent App. No. 201080009100.0, Sharp Kabushiki Kaisha, mailed Aug. 30, 2013, 2 pgs.
Japanese Official Communication, Japanese Patent App. No. 2011-532403, Sharp Kabushiki Kaisha, mailed Sep. 3, 2013, 4 pgs.
Patent Abstract of Japan—Japanese Patent Pub. No. 2008-304908, published Dec. 18, 2008, Victor Co. of Japan Ltd., 1 pg.
Patent Abstract of Japan—Japanese Patent Pub. No. 2005-258404, published Sep. 22, 2005, Hitachi Ltd, Hitachi Displays Ltd., 1 pg.
Patent Abstract of Japan—Japanese Patent Pub. No. 2008-071603, published Mar. 27, 2008, Sharp Corp., 1 pg.
Patent Abstract of Japan—Japanese Patent Pub. No. 02-077659, published Mar. 16, 1990, NEC Corp., 1 pg.

* cited by examiner

LCD system configuration

| | | | | | | | |
|---|---|---|---|---|---|---|---|
| 0.04 | 0.08 | 0.14 | 0.19 | 0.14 | 0.08 | 0.04 |
| 0.06 | 0.15 | 0.61 | 0.61 | 0.40 | 0.15 | 0.06 |
| 0.07 | 0.20 | 0.62 | 1.00 | 0.62 | 0.20 | 0.07 |
| 0.06 | 0.15 | 0.40 | 0.61 | 0.40 | 0.15 | 0.06 |
| 0.04 | 0.08 | 0.14 | 0.19 | 0.14 | 0.08 | 0.04 |

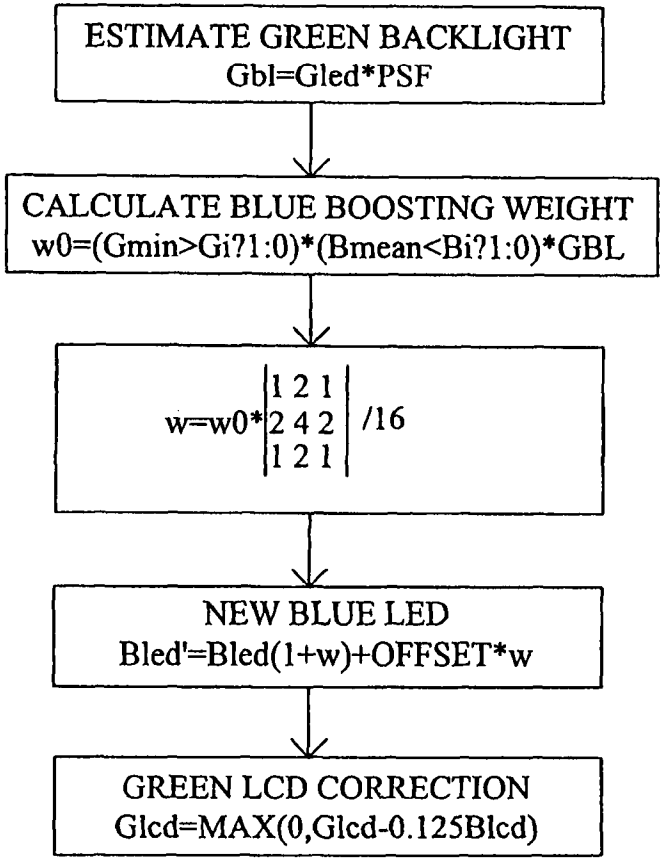

ESTIMATE THE GREEN BACKLIGHT
BY CONVOLVE GREEN LED WTIH PSF

CALCULATE THE BLUE LED BOOST WEIGHT
MINIMUM G OR MEAN G LESS THAN A THRESHOLD (0.125)
MEAN B IS GREATER THAN A THRESHOLD
WEIGHTED BY GREEN BACKLIGHT

BLUR THE WEIGHTING MAP BY CONVOLVING
WITH A BLUR KERNEL

INCREASE THE BLUE LED BASED ONTHE WEIGHT

IF GREEN LCD GREATER THAN A THRESHOLD,
REDUCE THE GREEN LCD TO COMPENSATE FOR
THE BLUE FILTER LEAKAGE,
ELSE SET Glcd TO ZERO

FIG. 12

AREA ADAPTIVE BACKLIGHT WITH REDUCED COLOR CROSSTALK

CROSS-REFERENCE TO RELATED APPLICATIONS

Not applicable.

BACKGROUND OF THE INVENTION

The present invention relates to backlit displays and, more particularly, to a backlit display with improved performance characteristics.

The local transmittance of a liquid crystal display (LCD) panel or a liquid crystal on silicon (LCOS) display can be varied to modulate the intensity of light passing from a backlit source through an area of the panel to produce a pixel that can be displayed at a variable intensity. Whether light from the source passes through the panel to a viewer or is blocked is determined by the orientations of molecules of liquid crystals in a light valve.

Since liquid crystals do not emit light, a visible display requires an external light source. Small and inexpensive LCD panels often rely on light that is reflected back toward the viewer after passing through the panel. Since the panel is not completely transparent, a substantial part of the light is absorbed during its transit of the panel and images displayed on this type of panel may be difficult to see except under the best lighting conditions. On the other hand, LCD panels used for computer displays and video screens are typically backlit with fluorescent tubes or arrays of light-emitting diodes (LEDs) that are built into the sides or back of the panel. To provide a display with a more uniform light level, light from these points or line sources is typically dispersed in a diffuser panel before impinging on the light valve that controls transmission to a viewer.

The transmittance of the light valve is controlled by a layer of liquid crystals interposed between a pair of polarizers. Light from the source impinging on the first polarizer comprises electromagnetic waves vibrating in a plurality of planes. Only that portion of the light vibrating in the plane of the optical axis of a polarizer can pass through the polarizer. In an LCD, the optical axes of the first and second polarizers are arranged at an angle so that light passing through the first polarizer would normally be blocked from passing through the second polarizer in the series. However, a layer of the physical orientation of the molecules of liquid crystal can be controlled and the plane of vibration of light transiting the columns of molecules spanning the layer can be rotated to either align or not align with the optical axes of the polarizers. It is to be understood that a normally white mode may be used for the layer of liquid crystals.

The surfaces of the first and second polarizers forming the walls of the cell gap are grooved so that the molecules of liquid crystal immediately adjacent to the cell gap walls will align with the grooves and, thereby, be aligned with the optical axis of the respective polarizer. Molecular forces cause adjacent liquid crystal molecules to attempt to align with their neighbors with the result that the orientation of the molecules in the column spanning the cell gap twist over the length of the column. Likewise, the plane of vibration of light transiting the column of molecules will be "twisted" from the optical axis of the first polarizer to that of the second polarizer. With the liquid crystals in this orientation, light from the source can pass through the series polarizers of the translucent panel assembly to produce a lighted area of the display surface when viewed from the front of the panel. It is to be understood that the grooves may be omitted in some configurations.

To darken a pixel and create an image, a voltage, typically controlled by a thin-film transistor, is applied to an electrode in an array of electrodes deposited on one wall of the cell gap. The liquid crystal molecules adjacent to the electrode are attracted by the field created by the voltage and rotate to align with the field. As the molecules of liquid crystal are rotated by the electric field, the column of crystals is "untwisted," and the optical axes of the crystals adjacent the cell wall are rotated out of alignment with the optical axis of the corresponding polarizer progressively reducing the local transmittance of the light valve and the intensity of the corresponding display pixel. Color LCD displays are created by varying the intensity of transmitted light for each of a plurality of primary color elements (typically, red, green, and blue) that make up a display pixel.

LCDs can produce bright, high resolution, color images and are thinner, lighter, and draw less power than cathode ray tubes (CRTs). As a result, LCD usage is pervasive for the displays of portable computers, digital clocks and watches, appliances, audio and video equipment, and other electronic devices. On the other hand, the use of LCDs in certain "high end markets," such as video and graphic arts, is frustrated, in part, by the limited performance of the display.

What is desired, therefore, is a liquid crystal display having reduced blur.

BRIEF DESCRIPTION OF THE SEVERAL VIEWS OF THE DRAWINGS

FIG. 12 illustrates a technique to reduce color crosstalk.

DETAILED DESCRIPTION OF PREFERRED EMBODIMENT

Figure 1A:
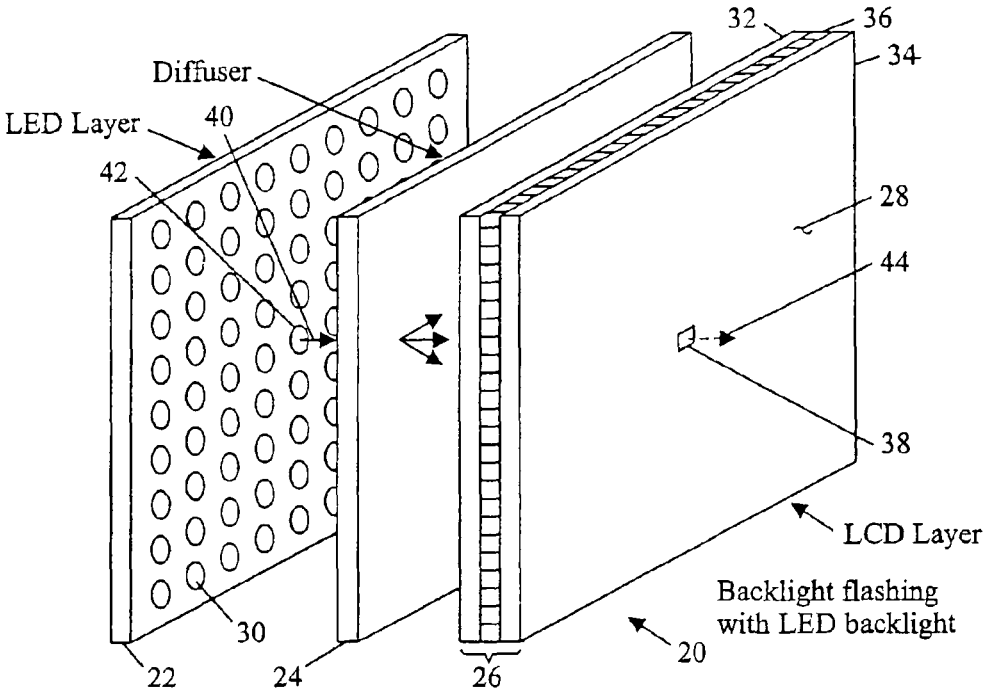
FIGS. 1A and 1B are schematic diagrams of liquid crystal displays (LCDs).
Figure 1B:
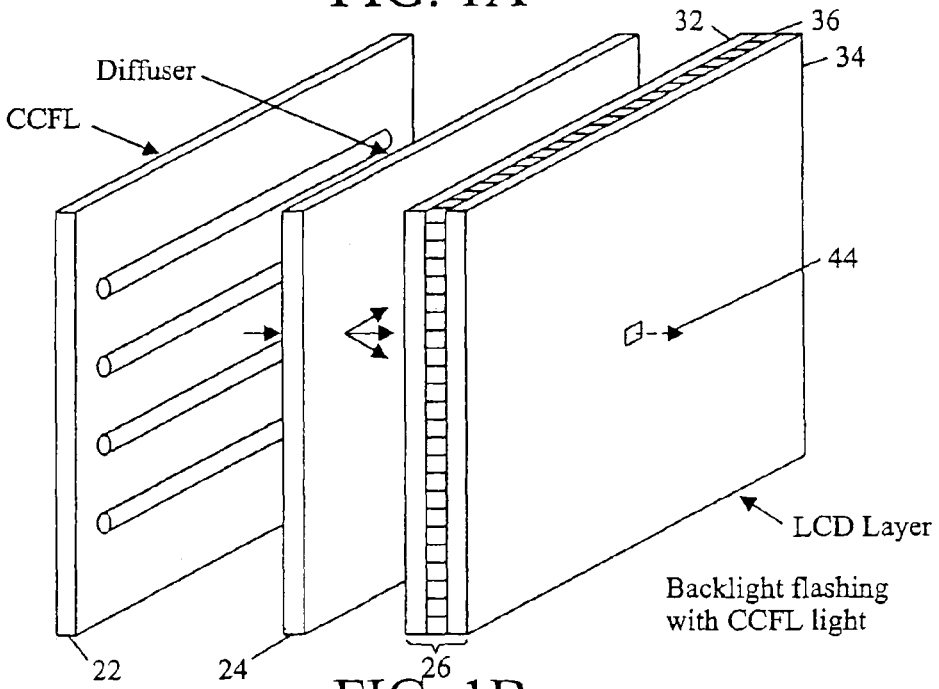

Referring to FIG. 1A, a backlit display 20 comprises, generally, a backlight 22, a diffuser 24, and a light valve 26 (indicated by a bracket) that controls the transmittance of light from the backlight 22 to a user viewing an image displayed at the front of the panel 28. The light valve, typically comprising a liquid crystal apparatus, is arranged to electronically control the transmittance of light for a picture element or pixel. Since liquid crystals do not emit light, an external source of light is necessary to create a visible image. The source of light for small and inexpensive LCDs, such as those used in digital clocks or calculators, may be light that is reflected from the back surface of the panel after passing through the panel. Likewise, liquid crystal on silicon (LCOS) devices rely on light reflected from a backplane of the light valve to illuminate a display pixel. However, LCDs absorb a significant portion of the light passing through the assembly and an artificial source of light such as the backlight 22 comprising fluorescent light tubes or an array of light sources 30 (e.g., light-emitting diodes (LEDs), as illustrated in FIG. 1A and fluorescent tubes as illustrated in FIG. 1B), are useful to produce pixels of sufficient intensity for highly visible images or to illuminate the display in poor lighting conditions. There may not be a light source 30 for each pixel of the display and, therefore, the light from the general point sources (e.g., LEDS) or general line sources (e.g., fluorescent tubes) is typically dispersed by a diffuser panel 24 so that the lighting of the front surface of the panel 28 is more uniform.

Light radiating from the light sources 30 of the backlight 22 comprises electromagnetic waves vibrating in random planes. Only those light waves vibrating in the plane of a polarizer's optical axis can pass through the polarizer. The light valve 26 includes a first polarizer 32 and a second polarizer 34 having optical axes arrayed at an angle so that normally light cannot pass through the series of polarizers. Images are displayable with an LCD because local regions of a liquid crystal layer 36 interposed between the first 32 and second 34 polarizer can be electrically controlled to alter the alignment of the plane of vibration of light relative of the optical axis of a polarizer and, thereby, modulate the transmittance of local regions of the panel corresponding to individual pixels 36 in an array of display pixels.

The layer of liquid crystal molecules 36 occupies a cell gap having walls formed by surfaces of the first 32 and second 34 polarizers. The walls of the cell gap are rubbed to create microscopic grooves aligned with the optical axis of the corresponding polarizer. The grooves cause the layer of liquid crystal molecules adjacent to the walls of the cell gap to align with the optical axis of the associated polarizer. As a result of molecular forces, each successive molecule in the column of molecules spanning the cell gap will attempt to align with its neighbors. The result is a layer of liquid crystals comprising innumerable twisted columns of liquid crystal molecules that bridge the cell gap. As light 40 originating at a light source element 42 and passing through the first polarizer 32 passes through each translucent molecule of a column of liquid crystals, its plane of vibration is twisted so that when the light reaches the far side of the cell gap its plane of vibration will be aligned with the optical axis of the second polarizer 34. The light 44 vibrating in the plane of the optical axis of the second polarizer 34 can pass through the second polarizer to produce a lighted pixel 28 at the front surface of the display 28.

To darken the pixel 28, a voltage is applied to a spatially corresponding electrode of a rectangular array of transparent electrodes deposited on a wall of the cell gap. The resulting electric field causes molecules of the liquid crystal adjacent to the electrode to rotate toward alignment with the field. The effect is to untwist the column of molecules so that the plane of vibration of the light is progressively rotated away from the optical axis of the polarizer as the field strength increases and the local transmittance of the light valve 26 is reduced. As the transmittance of the light valve 26 is reduced, the pixel 28 progressively darkens until the maximum extinction of light 40 from the light source 42 is obtained. Color LCD displays are created by varying the intensity of transmitted light for each of a plurality of primary color elements (typically, red, green, and blue) elements making up a display pixel. Other arrangements of structures may likewise be used.

The LCD uses transistors as a select switch for each pixel, and adopts a display method (hereinafter, called as a "hold-type display"), in which a displayed image is held for a frame period. In contrast, a CRT (hereinafter, called as an "impulse-type display") includes selected pixel that is darkened immediately after the selection of the pixel. The darkened pixel is displayed between each frame of a motion image that is rewritten in 60 Hz in case of the impulse-type display like the CRT. That is, the black of the darkened pixel is displayed excluding a period when the image is displayed, and one frame of the motion image is presented respectively to the viewer as an independent image. Therefore, the image is observed as a clear motion image in the impulse-type display. Thus, the LCD is fundamentally different from CRT in time axis hold characteristic in an image display. Therefore, when the motion image is displayed on a LCD, image deterioration such as blurring the image is caused. The principal cause of this blurring effect arises from a viewer that follows the moving object of the motion image (when the eyeball movement of the viewer is a following motion), even if the image is rewritten, for example, at 60 Hz discrete steps. The eyeball has a characteristic to attempt to smoothly follow the moving object even though it is discretely presented in a "hold type" manner.

In the hold-type display, the displayed image of one frame of the motion image is held for one frame period, and is presented to the viewer during the corresponding period as a still image. Therefore, even though the eyeball of the viewer smoothly follows the moving object, the displayed image stands still for one frame period. Therefore, the shifted image is presented according to the speed of the moving object on the retina of the viewer. Accordingly, the image will appear blurred to the viewer due to integration by the eye. In addition, since the change between the images presented on the retina of the viewer increases with greater speed, such images become even more blurred.

In the backlit display 20, the backlight 22 comprises an array of locally controllable light sources 30. The individual light sources 30 of the backlight may be light-emitting diodes (LEDs), an arrangement of phosphors and lenses, or other suitable light-emitting devices. In addition, the backlight may include a set of independently controllable light sources, such as one or more cold cathode ray tubes. The light-emitting diodes may be 'white' and/or separate colored light emitting diodes. The individual light sources 30 of the backlight array 22 are independently controllable to output light at a luminance level independent of the luminance level of light output by the other light sources so that a light source can be modulated in response to any suitable signal. Similarly, a film or material may be overlaid on the backlight to achieve the spatial and/or temporal light modulation.

Figure 2:
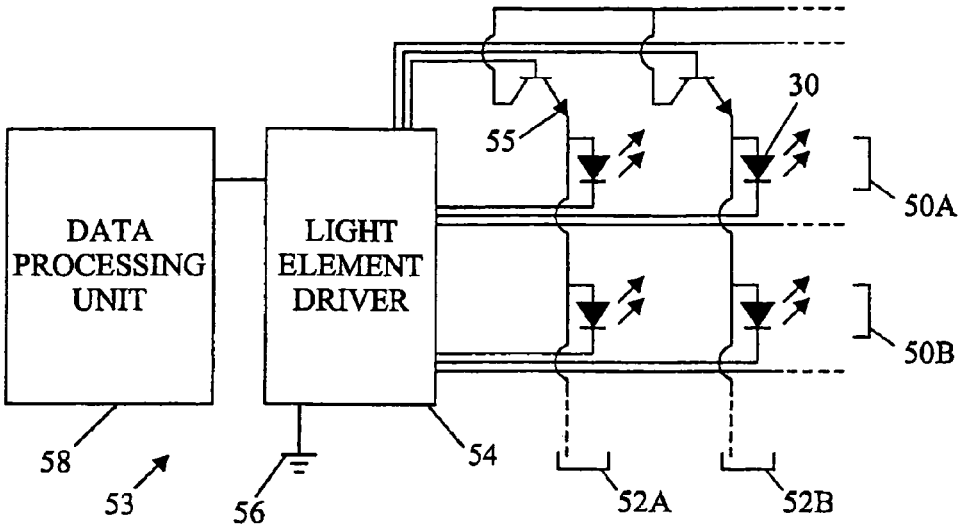
FIG. 2 is a schematic diagram of an exemplary driver for modulating the illumination of a plurality of light source elements of a backlight.

Referring to FIG. 2, the light sources 30 (LEDs illustrated) of the array 22 are typically arranged in the rows, for examples, rows 50*a* and 50*b*, (indicated by brackets) and columns, for examples, columns 52*a* and 52*b* (indicated by brackets) of a rectangular array. The output of the light sources 30 of the backlight are controlled by a backlight driver 53. The light sources 30 are driven by a light source driver 54 that powers the elements by selecting a column of elements 52*a* or 52*b* by actuating a column selection transistor 55 and connecting a selected light source 30 of the selected column to ground 56. A data processing unit 58, processing the digital values for pixels of an image to be displayed, provides a signal to the light driver 54 to select the appropriate light source 30 corresponding to the displayed pixel and to drive the light source with a power level to produce an appropriate level of illumination of the light source.

Figure 3:
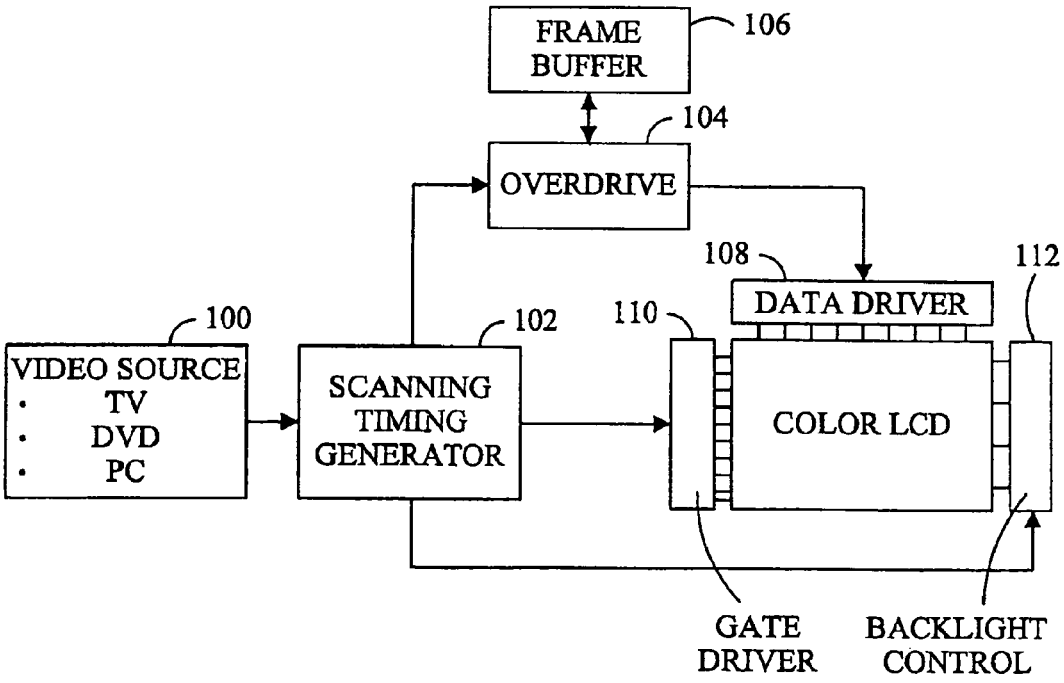
FIG. 3 illustrates an exemplary LCD system configuration.

FIG. 3 illustrates a block diagram of a typical data path within a liquid crystal panel. The video data 100 may be provided from any suitable source, such as for example, television broadcast, Internet connection, file server, digital video disc, computer, video on demand, or broadcast. The video data 100 is provided to a scanning and timing generator 102 where the video data is converted to a suitable format for presentation on the display. In many cases, each line of data is provided to an overdrive circuit 104, in combination with a frame buffer 106, to compensate for the slow temporal response of the display. The overdrive may be analog in nature, if desired. The signal from the overdrive 104 is preferably converted to a voltage value in the data driver 108 which is output to individual data electrodes of the display. The generator 102 also provides a clock signal to the gate driver 110, thereby selecting one row at a time, which stores the voltage data on the data electrode on the storage capacitor of each pixel of the display. The generator 102 also provides backlight control signals 112 to control the level of luminance from the backlight, and/or the color or color balance of the light provided in the case of spatially non-uniform backlight (e.g., based upon image content and/or spatially different in different regions of the display).

Liquid crystal displays have limited dynamic range due the extinction ratio of polarizers and imperfection of the liquid crystal material. In order to display high dynamic images, a low resolution light emitting diode (LED) backlight system may be used to modulate the light that feeds into the liquid crystal material. By the combination of LED and LCD, a very high dynamic range display can be achieved. For cost reasons, the LED typically has lower spatial resolution than the LCD. Due to the lower resolution LED, the high dynamic range display based on this technology can not display a high dynamic pattern of high spatial resolution. But it can display both very bright image (>2000 cd/m$^2$) and very dark image (<0.5 cd/m$^2$) simultaneously. The inability to display high dynamic range of high spatial resolution is not a serious issue since the human eye has limited dynamic range in a local area, and with visual masking, the human eye can hardly perceive the limited dynamic range of high spatial frequency content.

Figure 4:
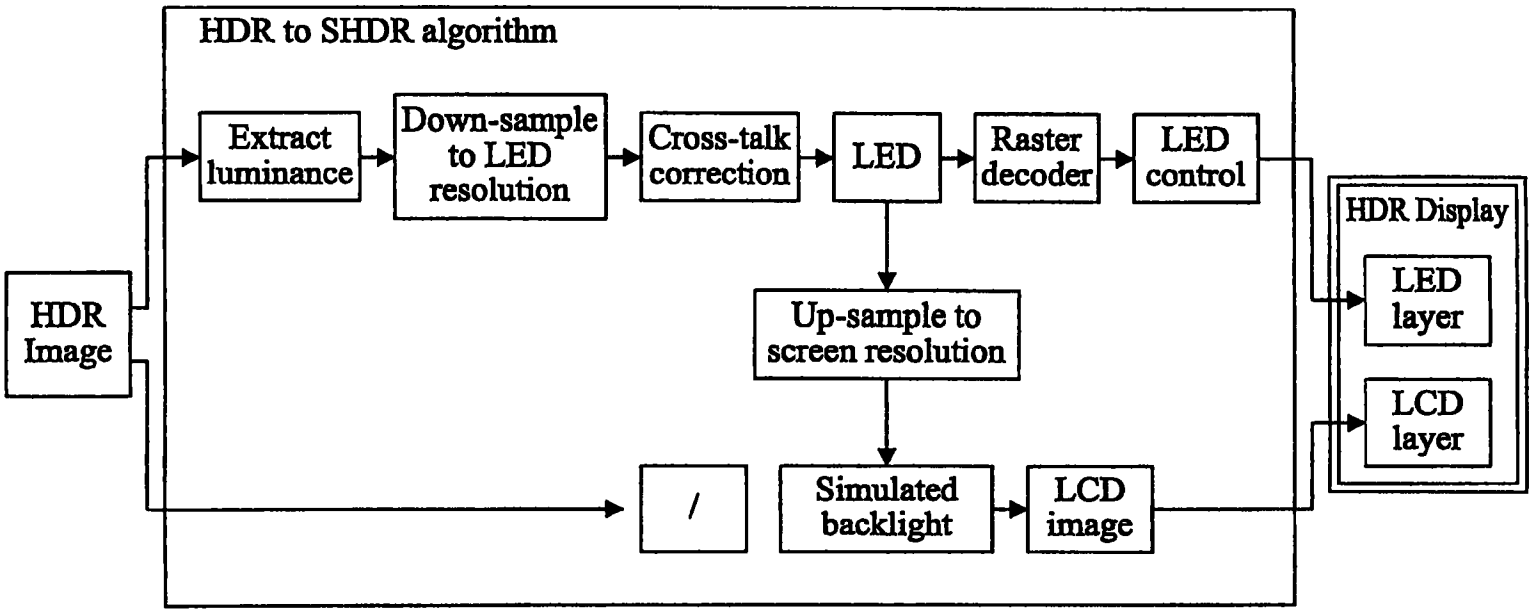
FIG. 4 illustrates a high dynamic range image processing technique.

FIG. 4 illustrates one previously existing technique to convert a high spatial resolution high dynamic range (HDR) image into a lower resolution light emitting diode (LED) image and a high resolution liquid crystal display image. The luminance is extracted from the HDR image. The extracted luminance is then low pass filtered and sub-sampled to the resolution of the LED array. The filtered and sub-sampled image may be processed to reduce cross talk effects. The cross-talk corrected image may be sent to a raster decoder and displayed on the LED layer of the HDR display.

The desirable backlight image may be predicted by convolving an up-sampled LED image with the point spread function of LED. The LCD image is derived by dividing the original HDR image with predicted backlight image to obtain the simulated backlight. Since the final displayed image is the product of LED backlight image and the LCD transmittance, this approach reproduces the original HDR image. Unfortunately, the resulting displayed images using this technique tends to have limited bright specular highlights that are limited in spatial extent. Accordingly, many HDR images contains specular highlight that are extremely bright, but very small in spatial extent, which may not be adequately represented on the display.

It was determined that the low pass filtering process smears this specular highlight causing the corresponding LED to have a lower value. Traditionally it would have been thought that any of the spatial details lost in the low pass filtering process could be recovered in the division operation. Although any spatial details lost in the filtering step can be theoretically recovered in the LCD image via the division operation, it turns out that the LCD can not recover the bright specular highlight due to its limited range (its transmittance can not exceed 1). Thus specular highlights are lost in the final display image although the HDR is capable of displaying that bright highlight.

It was also determined that the low pass filtering works well for regions of the image that are not at the extremes of brightness and darkness. Accordingly, another criteria may be used to account for those regions where the low pass filtering is not exceptionally effective. In addition to using the low pass filtered image to derive the LED image, the system may also use the maximum image (or some value associated with regions where a significant value exists) which is the local maximum in the HDR image divided by the max transmittance of LCD.

In addition, it was determined that the broad spread in the LED point spread function (PSF), results in decreasing the potential contrast ratio of the image and also fails to minimize the power consumption of the display. In order to improve the contrast ratio a modified approach may be used to derive the LED driving value to achieve a higher contrast in the backlight image. The resulting higher contrast backlight image combining with the high resolution LCD image can produce much higher dynamic image to be displayed and also reduce the power consumption of the LED backlight.

Upon yet further investigation, moving images tend to flicker more than expected, i.e. the fluctuation of display output. After consideration of a particular configuration of the display, namely a LCD combined with LED array, it was determined that the temporal response of the LCD layer is different than the LED array in a manner that may result in flickering. In general, the LED has a much faster temporal response than the LCD layer. In addition, these errors resulting in flickering may be due to inaccuracies in the point spread function approximation, which may vary from display to display, and from LED to LED. In addition, the course nature of the LED array tends to result in course selection of the LED values, generally being on or off.

FIG. 1 shows a schematic of a HDR display with LED layer as a backlight for a LCD. The light from array of LEDs passes through the diffusion layer and illuminates the LCD. The backlight image is given by:

$$bl(x,y)=\mathrm{LED}(i,j)*psf(x,y) \tag{1}$$

where LED(i,j) is the LED output level of each LED, and psf(x,y) is the point spread function of the diffusion layer. * denotes convolution operation. The backlight image is further modulated by the LCD.

The displayed image is the product of LED backlight and transmittance of LCD: $T_{LCD}(x, y)$.

$$img(x,y)=bl(x,y)T_{LCD}(x,y)=(\mathrm{led}(i,j)*psf(x,y))T_{LCD}(x,y) \tag{2}$$

By combining the LED and LCD, the dynamic range of display is the product of the dynamic range of LED and LCD. For simplicity, the notation may use normalized LCD and LED output limited to between 0 and 1.

Figure 5:
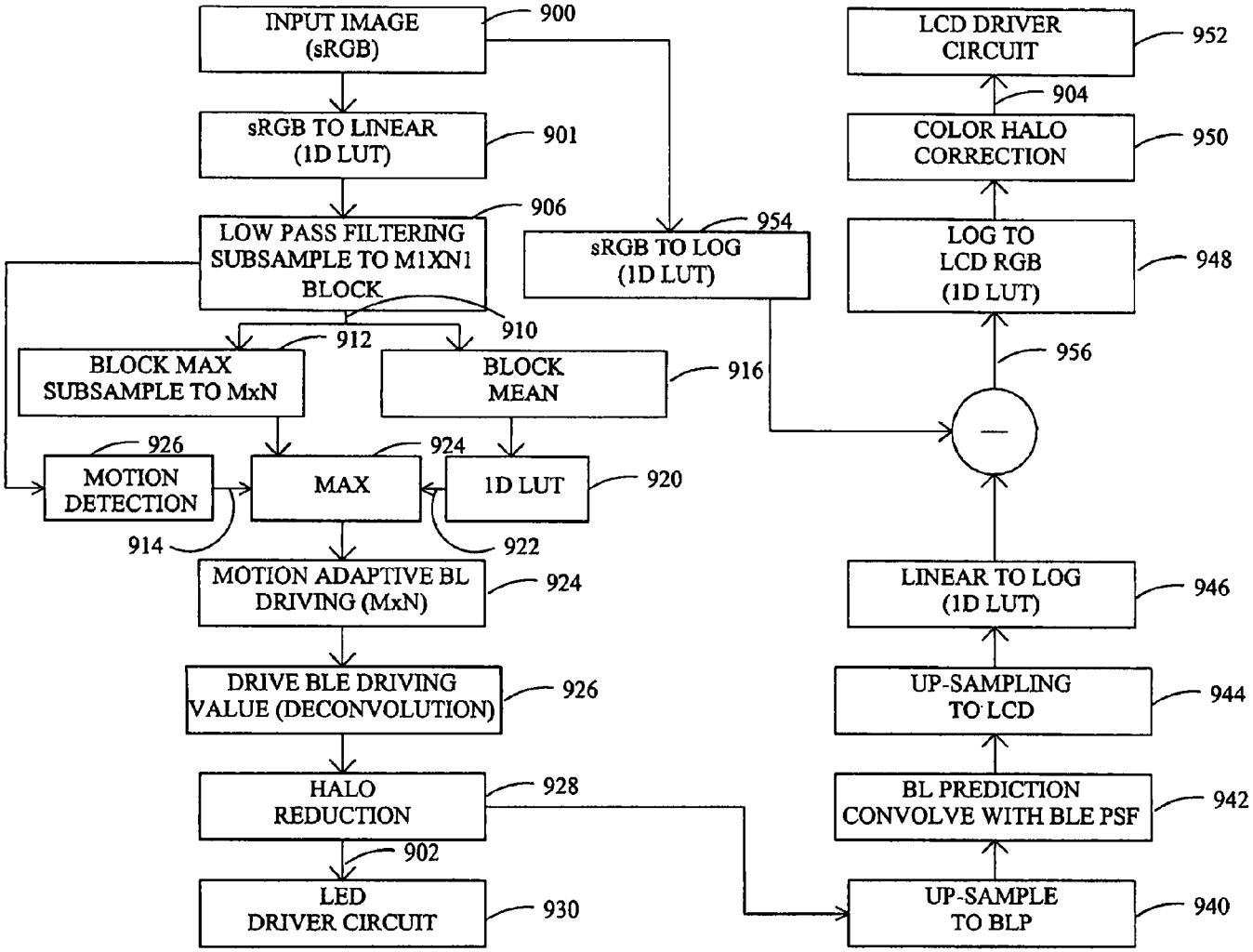
FIG. 5 illustrates LED and LCD driving values.

FIG. 5 shows an exemplary technique to convert a HDR image 900 into a low resolution LED image 902 and a high resolution LCD image 904. The LCD resolution is m×n pixels with its range from 0 to 1, with 0 to be black and 1 to be the maximum transmittance. The LED resolution is M×N with M<m and N<n. For simplicity it may be assumed that the HDR image has the same resolution as LCD. If HDR image is of different resolution, a scaling or cropping step may be used to convert the HDR image to LCD image resolution.

The HDR image, such as in sRGB color space, may be linearized using a 1-dimensional look up table 901. The linearized HDR image is low pass filtered by the point spread function of the diffusion screen (or other function) and subsampled (down sample) to an intermediate resolution (M1×N1) 906. One example of an intermediate resolution is eight times the LED resolution (8M×8N). The extra resolution of the subsampled image may be used to reduce flickering that would occur as a result of moving objects over a series of frames of a video, and to preserve specular highlights. The additional data points in the LED matrix also permit a smoothing of the transition of the LED values when movement occurs in the image of a video. This facilitates one LED to gradually decrease in value as an adjacent LED gradually increases in value, which reduces the resulting flickering of the image that would result if the changes were more abrupt.

For each block of pixels of the low-pass filtered subsampled image 910 the block maximum 912 (or other suitable value) is selected. If desired, the processing of each block may correspond to the intermediate resolution with some overlap between each block, i.e., the block size is (1+k)*(m/M×n/N), where k (i.e., 0.25) is the overlapping factor. For each block, the block maximum (or other suitable value) is used to form a LEDmax image (M×N) 914. It is to be understood that any suitable technique may be used to define the maximum (or other suitable value) for each location based upon the pixel location, region, and/or neighboring regions.

Figure 6:
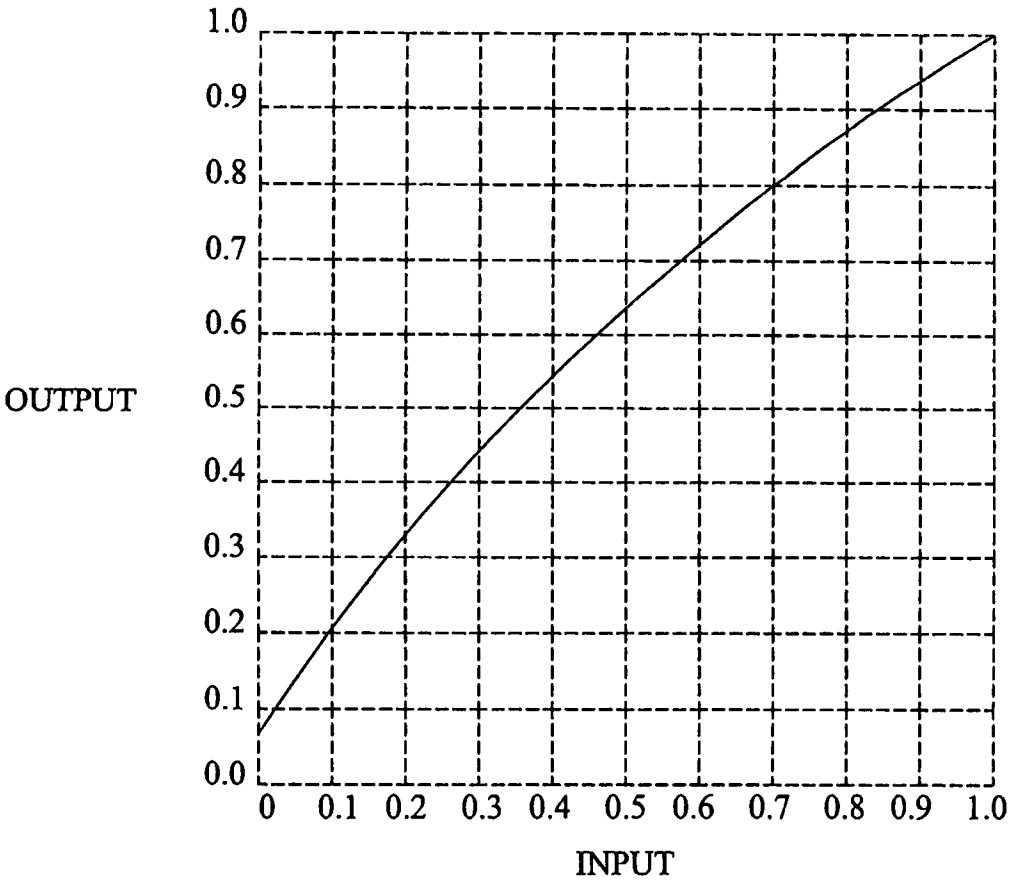
FIG. 6 illustrates tone mapping.

For each block of pixels of the low-pass filtered subsampled image 910 the block mean 916 (or other suitable value) is selected. If desired, the processing of each block may correspond to the intermediate resolution with some overlap between each block, i.e., the block size is (1+k)*(m/M×n/N), where k (i.e., 0.25) is the overlapping factor. For each block, the mean value (or other suitable value) is used to form a LEDmean image (M×N) 918. The mean image 918 may include a set of values at the dark portion of the range in a uniform area, then with the combination of a low backlight level the LCD tends to either be generally not transmissive or generally fully transmissive. Having the LCD operate at its extremes tends to appear noisy with a noisy input. To enhance the mean image 918 to reduce its resulting visual noise a one-dimensional look up table 920 may be used that includes a dark region offset and non-linear expansion across its range to boost the values in the dark region, such as illustrated in FIG. 6. This provides an offset mean tone-adjusted image 922. It is to be understood that any suitable technique may be used to define the mean (or other suitable value) for each location based upon the location, region, and/or neighboring regions.

From these two LED images 914 and 922, the larger of LEDmax 914 and LEDmean 922 is selected 924. This larger value helps account for the fact that the low pass filtering tends to decrease the dynamic range that would otherwise have been rendered on the display. Taking into account the local maximum assists to preserve the specular highlights. If desired, for non specular highlight areas the system may increase the backlight levels, which is compensated by the LCD, to ensure operation toward the lower end of the LCD tone curve.

The output of the max 924 is the target backlight level and its size may be the same as the number of active backlight blocks (M×N). As previously noted, intensity fluctuations, generally referred to as flickering, may be observed when an object moves across LED boundaries. The object movement causes an abrupt change in the LED driving values. Theoretically, the change in backlight can be compensated by the LCD. But due to timing differences between the LED and LCD, and the mismatch in the point-spread-function used in calculation of the compensation and the actual point spread function of the LED, there is some small intensity variations. Minor small intensity variations are frequently not objectionable. However, when the eye of a viewer is tracking an object, then the small backlight changes become a periodic objectionable fluctuation. The frequency of the fluctuation is the product of the video frame rate and object motion speed in terms of LED blocks per frame. If an object moves across a LED block in 8 video frames and the video frame rate is 60 Hz, the flickering frequency is 60 hz*0.125=7.5 Hz. This is about at the peak of the human visual sensitivity to flickering and it makes a very annoying artifact. To reduce this motion flickering, the system may include a motion adaptive technique 924 to reduce the sudden LED change when an object moves across the LED grids.

The motion adaptive technique 924 may use motion detection 926, which may be the classification of the video image into two classes, those regions with sufficient motion and those regions without sufficient motion. In the motion region, the backlight contrast may be reduced so that there is less sudden changes in the LED driving value. In the insufficient motion region, the backlight contrast may be preserved to improve the contrast ratio and reduce power consumption.

Motion detection may be performed at the subsampled image at M1×N1 resolution. The value at current frame may be compared to the corresponding block in the previous frame. If the difference is greater than a threshold, then the backlight block that contains this block is classified as motion block. In the preferred embodiment, each backlight block contains 8×8 sub-blocks. The process of motion detection may be as follows:

For each frame:

(1) Calculate the average of each sub-block in the input image for the current frame.

(2) If the difference between the average in this frame and the sub-block average of the previous frame is greater than a threshold (such as 5% of total range), then backlight block that contains the sub-block is a motion block. Thus a first motion map is formed.

(3) Perform a morphological dilation operation on the motion map (change the still blocks neighboring to a motion block to motion block) to form a second enlarged motion map.

(4) For each backlight block, the motion status map is updated based on the motion detection results:

```
(i) if it is motion block,
        mMap(i,j)=min(4, mMap (i,j)+1);
(ii) else (still block)
        mMap (i,j)=max(0, mMap (i,j)−1).
```

The LED driving value is given by $$LED_2(i, j) = \left(1 - \frac{mMap}{4}\right) LED_1(i, j) + \frac{mMap}{4} LED_{max}(i, j) \tag{3}$$

Where $LED_{max}$ is the local max of LEDs in a window that centers on the current LED. One example is a 3×3 window. Another example is a 5×5 window.

An alternative embodiment is using motion estimation. The window is aligned with the motion vector. This approach reduces the window size and preserves the contrast in the non motion direction, but the computation of motion vectors is more complex than motion detection.

Figure 7:
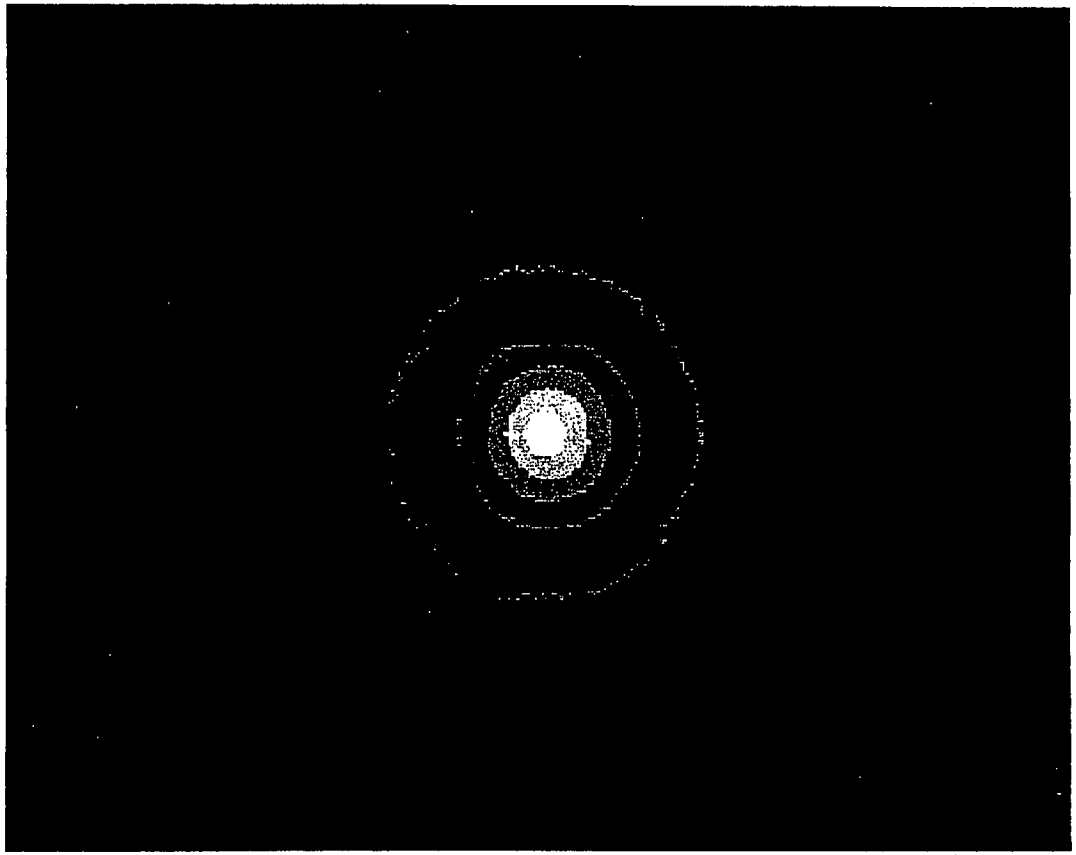
FIG. 7 illustrates LED PSF.

Since the PSF of LED is larger than the LED spacing to provide a more uniform backlight image, there is considerable crosstalk between the LED elements that are located close together. The LED may be of size M1×N1 and range from 0 to 1. Since the PSF of the diffusion screen is typically larger than the LED spacing in order to provide a more uniform backlight image, there tends to be considerable crosstalk between the LED elements that are located close together. FIG. 7 shows a typical LED PSF where the PSF extends beyond the boarder of a particular LED.

Because of the PSF of the diffusion screen, any LED has contribution from its entire neighboring LEDs. Although equation 2 can be used to calculate the backlight if given a LED driving signal, deriving LED driving signal to achieve a target backlight image is an inverse problem. This problem results in an ill posed de-convolution problem. Traditionally, a convolution kernel may be used to derive the LED driving signal, as shown in equation 3. The crosstalk correction kernel coefficients ($c_1$ and $c_2$) are negative to compensate for the crosstalk from neighboring LEDs.

$$\text{crosstalk} = \begin{vmatrix} c_2 & c_1 & c_2 \\ c_1 & c_0 & c_1 \\ c_2 & c_1 & c_2 \end{vmatrix} \tag{4}$$

The crosstalk correction matrix does reduce the crosstalk effect from its immediate neighbors, but the resulting backlight image is still inaccurate with a low contrast. Another problem is that it produces many out of range driving values that have to be truncated which can result in more errors.

Since the LCD output can not be more than 1, the led driving value is derived so that backlight is larger than target luminance, i.e.

$$\text{led}(i,j):\{\text{led}(i,j)*psf(x,y)\geq I(x,y)\} \tag{5}$$

The syntax uses ":" to denote the constraint to achieve the desired LED values of the function in the curly bracket. Because of the limited contrast ratio (CR) due to leakage, LCD(x,y) generally can no longer reach 0. The solution is that when target value is smaller than LCD leakage, the led value is reduced to reproduce the dark luminance.

$$\text{led}(i,j):\{\text{led}(i,j)\otimes psf(x,y)<I(x,y)\cdot CR\} \tag{6}$$

Another feature is power saving so that the total LED output should be minimized or otherwise reduced.

$$led(i,\ j):\ \left\{\min\sum_{i,j} led(i,\ j)\right\} \tag{7}$$

Flickering is due, at least in part, to the non-stationary response of the LED which combines with the mismatch between the LCD and LED. The mismatch can be either spatially or temporally. Flickering can be reduced by decreasing the total LED output fluctuation as a point object move through the LED grid.

$$led(i,\ j):\ \left\{\min\left(\sum_{i,j} led(i,\ j) - \sum_{i,j} led(i-x_0,\ j-y_0)\right)\right\} \tag{8}$$

where $x_0$ and $y_0$ is the distance from the center of the LED. The flickering can be further reduced by temporal IIR filtering.

A computationally efficient technique to derive the backlight values that satisfy equations 6, 7, and 8 may involve the following steps:

(1) A single pass technique to derive the LED driving values with a constraint that led>0.

(2) Post-processing: for those LED with driving value more than a (maximum), threshold those values to 1 (or other suitable value) and then using an error diffusion technique distribute the error to its neighboring LEDs.

Figure 8:
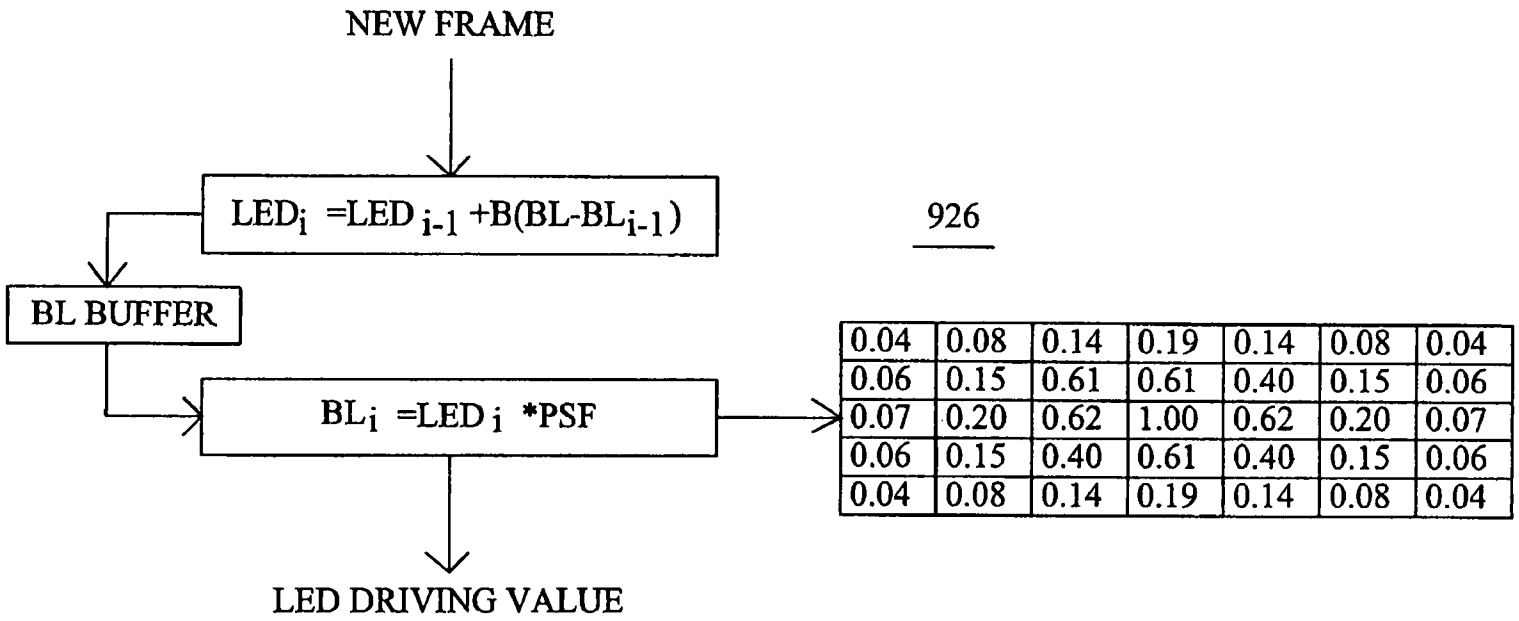
FIG. 8 illustrates a single pass LED driving scheme.

While an iterative technique may be used, the preferred technique to derive the LED driving values (see block 926 of FIG. 5) is non-iterative, and thus more computationally efficient. The preferred single pass technique is illustrated in FIG. 8. The difference between the target backlight (BL) of the new frame and the backlight ($BL_{i-1}$) of the previous frame is calculated. The backlight of the previous frame ($BL_{i-1}$) is provided by a BL buffer. This difference may be scaled by a scale factor, such as a scale factor that ranges from 0.5 to 2.0 times the inverse of the sum of the PSF. The new driving value ($LED_i$) is the sum of the previous LED driving value ($Led_{i-1}$) and the aforementioned scaled difference. The new backlight ($BL_i$) is then estimated by the convolution of the new LED driving value and the PSF of the LED.

Figure 9:
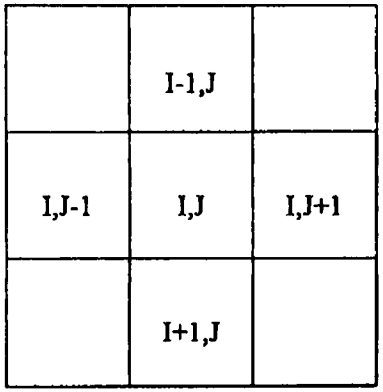
FIG. 9 illustrates error diffusion.

The derived LED value from the preferred single pass technique can be less than 0 and great than 1. Since the LED can only be driven between 0 (minimum) and 1 (maximum), these values should be truncated to the rage of 0 to 1. Truncation to 0 still satisfies equation 4, but truncation to 1 does not. This truncation causes a shortfall in the backlight. The shortfall to 1 may be compensated by increasing the driving value of its neighboring LEDs, such as illustrated in FIG. 9. Accordingly, information related to the previous backlight illumination is used to select the next backlight level.

A post processing technique may be used to diffuse this truncation error, such as follows:

```
(1)  For these led i,j>1.
(2)  tmpVal=led i,j -1.
(3)  Set led i,j =1.
(4)  Sort the 4 neighboring LEDs to ascending order.
(5)  If(max-min < min(diffThd, tmpVal/2)
         All the neighbor LEDs are increased by tmpVal/2.
(6)  Else
         They are increased by errWeight*tmpVal*2.
```

ErrWeight is the array for error diffusion coefficients based on the rank order. In the preferred embodiment, the errWeight=[0.75 0.5 0.5 0.25], where the largest coefficient is for the neighboring LED with the lowest driving value, and the smallest coefficient is for the neighboring LED with the driving value. In general, extra light is obtained by increasing the illumination of the LED(s) with less illumination, while simultaneously, decreasing the illumination from LCD(s) with greater illumination, such that the total illumination is substantially unchanged.

A similar diffusion process may be used to diffuse the error to the corner neighbors to further increase the brightness of small objects.

Figure 10:
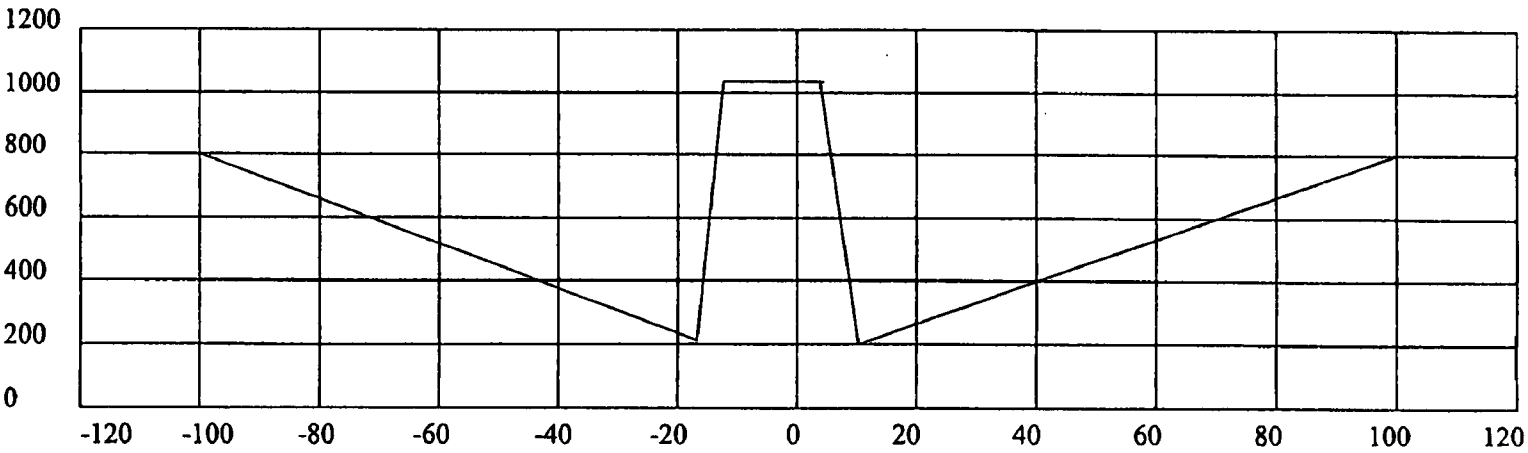
FIG. 10 illustrates a halo artifact.

Since the LED resolution is much lower than that of LCD, there are considerable amounts of spread in the LED PSF. If there is a sharp transition in the original image, the backlight for the dark region is considerably higher than needed, thus LCD layer may compensate. There are at least two problems with the compensation: (1) limited contrast ratio prevents an exact compensation, and (2) even if the compensation works well for normal viewing, it will not tend to work well at oblique viewing angles due to the angular dependence of the LCD transmittance. This mismatch between LED backlight and LCD may result in an undesirable halo artifact, as illustrated in FIG. 10.

To avoid or reduce this halo artifact (block 928 of FIG. 5), the LED driving values may be changed so that to reduce sudden backlight change in the dark region. The output of the halo reduction 928 results in the LED image 902 which may be provided to the LED driver circuit 930.

```
If led(i,j) < Halo_low
        For(l=-halo_size_x:halo_size_x)
            For(k=halo_size_y:halo_size_y)
                If(led(i-k,j-l)> halo_high)
                    d=sqrt(l*l+k*k)
                     Led(I,j)=led(I,j)+halo_blur(d)
                End
            End
        End
End
```

Thus, if a pixel value is below a threshold then the system looks in the neighborhood of the pixel. If there are bright pixel(s) in the neighborhood, then the system may boost the dark spot based on the distance to the bright pixel(s). The closer to the bright pixel the greater the boost.

Figure 11:
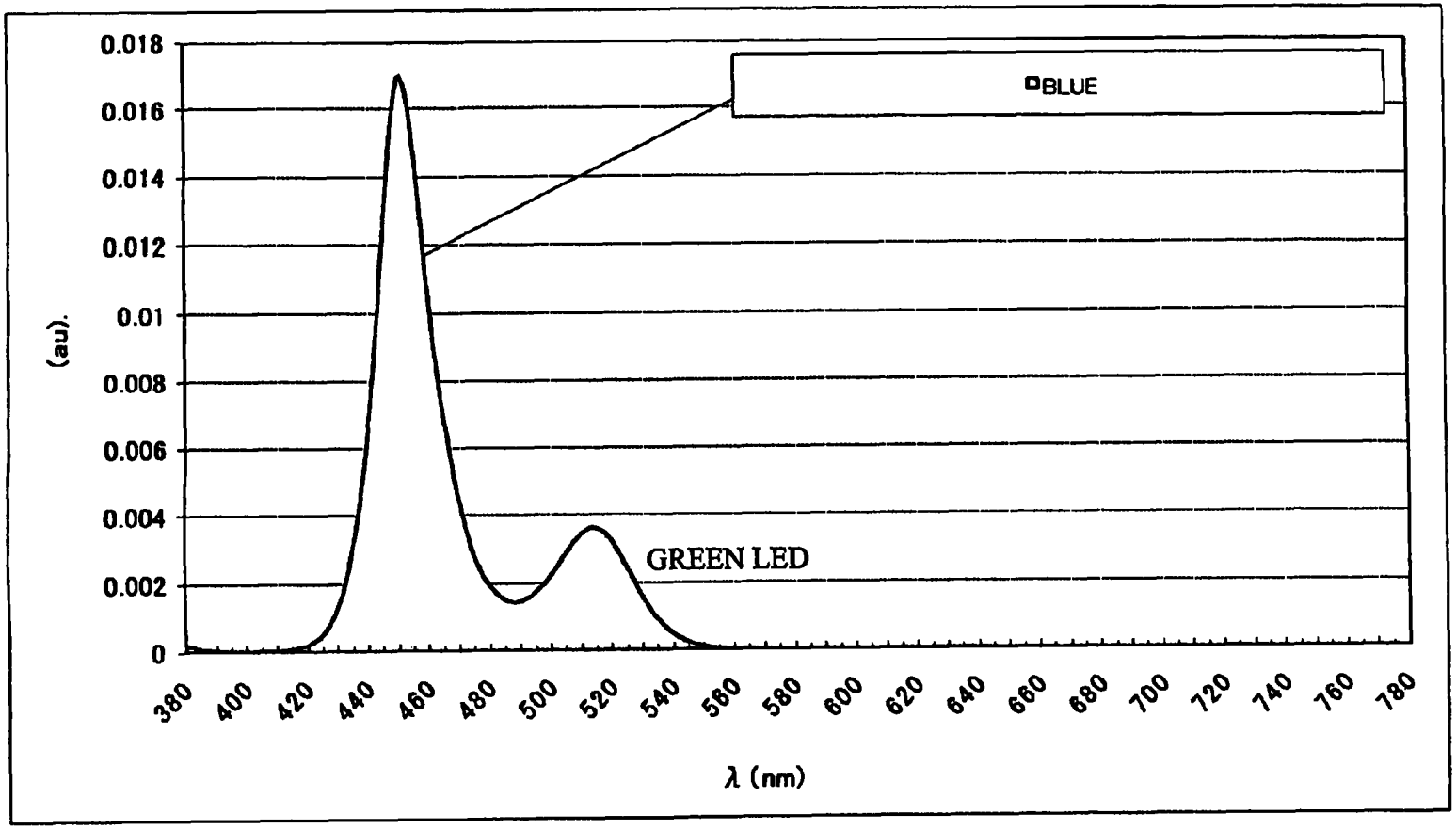
FIG. 11 illustrates color crosstalk.

Another artifact is the color halo due to the crosstalk between color LED and color filter of LCD. FIG. 11 shows the measured spectral of the blue (LCD) channel with both blue and green LED on. The second peak at the wavelength of 520 nm is from the green LED. This crosstalk causes color shift which proportional to the product of green LED and blue LCD.

Referring to FIG. 12, the crosstalk from the green LED to the blue LCD may be reduced using a suitable technique. The technique shown in FIG. 12 involves (1) a convolution of the green LED with the PSF, (2) boosting the blue weight, (3) blurring the weighted map, (4) increasing the blue LED based upon the weight, and (5) reduce the green LCD to compensate for the blue filter leakage. In a similar manner, the crosstalk from the green LED to the red LED; the blue LED to the green LCD; the blue LED to the red LCD; the red LED to the blue LCD; and the red LED to the green LCD may be reduced using a suitable technique.

In existing systems, the LCD transmittance is derived by dividing the input image by the backlight such as:

$$T_{LCD}(x,y)=img(x,y)/bl(x,y) \tag{9}$$

But division is computationally expensive to implement, so if one takes the logarithm of equation 9 it is computationally more efficient, as follows:

$$\log(T_{LCD}(x,y))=\log(img(x,y))-\log(bl(x,y)) \tag{10}$$

The LED image 902 may be up-sampled to the backlight predicted scale 940. This up-sampling predicted image may be convolved with the backlight element post spread function 942. Then this convolved data is up-sampled to the LCD sampling 944, to result in a backlight density.

Figure 13:
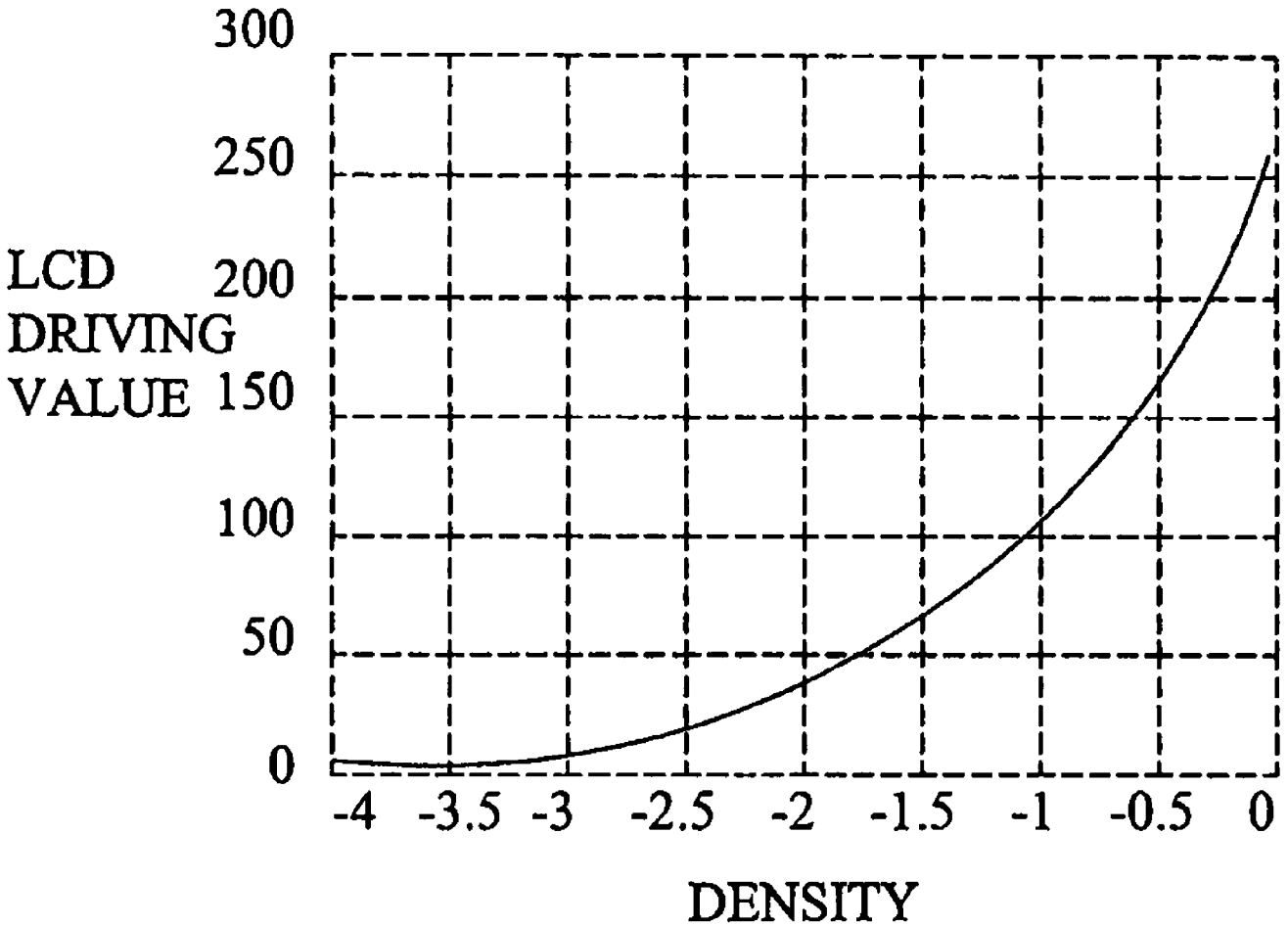
FIG. 13 illustrates LCD inverse gamma correction.

A one dimensional look-up-table (1D LUT) may be used to convert linear luminance values into density values such as block 946 and 954. The LCD density may be derived by subtracting the backlight density 946 from the image density 954 to obtain the LCD density 956. Another 1D LUT 948 may be used to convert the LCD density 956 into code value domain, as illustrated in FIG. 13. Color halo correction 950 may be applied to the output of the 1D LUT 948 to obtain the LCD image 904. The LCD image 904 is provided to the LCD driver circuit 952.

All the references cited herein are incorporated by reference.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array, wherein said backlight array has a plurality of different colored lighting elements;

(d) wherein said data provided to said backlight array is based at least in part upon modifying an intensity value corresponding to light emitted only by a first colored lighting element adjacent a second colored lighting element having a different color than said first colored lighting element to reduce the cross-talk between said first and second colored lighting elements, using a weighted intensity value corresponding to light emitted only by said second colored lighting element, where the weight of said intensity value of said second colored lighting element is based on the distance between said first colored lighting element and said second colored lighting element;

(e) wherein said data provided to said light valve corresponding to said lighting element is suitable to provide the desired illumination for said image.

2. The method of claim 1 wherein said data modification includes a convolution of a green LED with a point-spread-function.

3. The method of claim 2 wherein said data modification includes boosting the value of a weight on a blue LED.

4. The method of claim 3 wherein said data modification includes blurring a weighted map.

5. The method of claim 4 wherein said data modification includes increasing a blue LED based upon said weight.

6. The method of claim 5 wherein said data modification includes reducing the green LED to compensate for blue filter leakage.

7. A method for displaying an image on a liquid crystal display including a light valve and a backlight array of individually controllable lighting elements comprising:

(a) receiving an image;

(b) modifying said image to provide data to said light valve;

(c) modifying said image to provide data to said backlight array;

(d) wherein said data provided to said backlight array is based at least in part upon the constraint that if a value of light emitted by a first lighting element is below a first threshold value and if a value of light emitted by at least one neighboring lighting element, at the location of said first lighting element after being convolved with a point spread function, is above a second threshold value, then increasing the value of said first lighting element by an amount calculated using the value of said at least one neighboring lighting element, where said first threshold value and said second threshold value different from each other are stored in a memory and are such as to reduce a halo artifact around said first lighting element;

(e) wherein said data provided to said light valve corresponding to said lighting element is suitable to provide the desired illumination for said image.

8. The method of claim 7 wherein said at least one neighboring lighting element includes an adjacent lighting element.

9. The method of claim 7 wherein said at least one neighboring lighting element includes at least four adjacent lighting elements.

* * * * *

UNITED STATES PATENT AND TRADEMARK OFFICE

CERTIFICATE OF CORRECTION

PATENT NO. : 8,624,824 B2
APPLICATION NO. : 12/383194
DATED : January 7, 2014
INVENTOR(S) : Xiao-fan Feng It is certified that error appears in the above-identified patent and that said Letters Patent is hereby corrected as shown below:

In the Claims

Col. 12, Line 46, claim 6

Change "LED" to read --LCD--.

Signed and Sealed this
Thirtieth Day of December, 2014

Michelle K. Lee

Michelle K. Lee
*Deputy Director of the United States Patent and Trademark Office*